US010317110B2

(12) United States Patent
Maass et al.

(10) Patent No.: US 10,317,110 B2
(45) Date of Patent: Jun. 11, 2019

(54) METHODS FOR CONTROLLING A COMPRESSOR WITH DOUBLE SUCTION FOR REFRIGERATION SYSTEMS

(75) Inventors: Gunter Johann Maass, Joinville (BR); Dietmar Erich Bernhard Lilie, Joinville (BR); Marcos Guilherme Schwarz, Joinville (BR)

(73) Assignee: Embraco Indústria de Compressores e Soluções em Refrigeração Ltda. (BR)

( * ) Notice: Subject to any disclaimer, the term of this patent is extended or adjusted under 35 U.S.C. 154(b) by 1026 days.

(21) Appl. No.: 13/993,003

(22) PCT Filed: Dec. 9, 2011

(86) PCT No.: PCT/BR2011/000455
§ 371 (c)(1),
(2), (4) Date: Oct. 4, 2013

(87) PCT Pub. No.: WO2012/075555
PCT Pub. Date: Jun. 14, 2012

(65) Prior Publication Data

US 2014/0023524 A1 Jan. 23, 2014

(30) Foreign Application Priority Data

Dec. 10, 2010 (BR) ..... 1005090

(51) Int. Cl.
*F25B 49/02* (2006.01)
*F25B 5/02* (2006.01)
(Continued)

(52) U.S. Cl.
CPC ..... *F25B 5/02* (2013.01); *F04B 49/00* (2013.01); *F25B 41/043* (2013.01);
(Continued)

(58) Field of Classification Search
CPC ..... F25B 26/022; F25B 2400/0401; F25B 2400/0409; F25B 49/022; F25B 26/02; F25B 2600/02
(Continued)

(56) References Cited

U.S. PATENT DOCUMENTS 2,158,542 A * 5/1939 Hull ..... F25B 1/10 417/410.1
4,309,876 A * 1/1982 Leonard ..... F25B 49/022 62/117
(Continued)

FOREIGN PATENT DOCUMENTS

WO WO 2007/084138 7/2007

OTHER PUBLICATIONS

International Search Report dated Jul. 13, 2012 for International Application No. PCT/BR2011/000455.
(Continued)

*Primary Examiner* — Edward F Landrum
*Assistant Examiner* — Daniel C Comings
(74) *Attorney, Agent, or Firm* — Fay Sharpe LLP

(57) ABSTRACT

The present invention refers to methods for controlling a double suction compressor for application in refrigeration systems, capable of meeting the different demands for cost, efficiency and control of temperatures by means of techniques of complexity levels and different configurations of the elements from the control loop (temperature sensors, actuators, controllers, etc.). The proposed solutions include the description of a method for controlling and adjusting the refrigeration capacities of a refrigeration system equipped with a double suction compressor, the refrigeration system comprising compartments to be refrigerated and comprising at least two evaporators (20) positioned in the compartments to be refrigerated (60,70), the double suction compressor
(Continued)

(10) being controllable to alternate its compression capacity, the method comprising steps of (i) Continuously measuring at least a temperature coming from a temperature sensor (SET,SCT) associated with at least one of the evaporators (20) and (ii) acting in the compressor's (10) compression capacity, from the measurement of step (i).

27 Claims, 7 Drawing Sheets

(51) Int. Cl.
*F25B 41/04* (2006.01)
*F04B 49/00* (2006.01)

(52) U.S. Cl.
CPC .... *F25B 49/022* (2013.01); *F25B 2400/0401* (2013.01); *F25B 2400/0409* (2013.01); *F25B 2600/0251* (2013.01); *F25B 2600/2511* (2013.01); *F25B 2600/2521* (2013.01); *F25B 2700/21171* (2013.01); *F25D 2700/10* (2013.01)

(58) Field of Classification Search
USPC ..... 62/219, 226, 228.1, 197, 199
See application file for complete search history.

(56) References Cited

U.S. PATENT DOCUMENTS

| | | | | |
|---|---|---|---|---|
| 4,442,680 | A | 4/1984 | Barbier et al. | |
| 5,022,234 | A * | 6/1991 | Goubeaux ..... | G05D 23/1906 236/78 D |
| 5,531,078 | A | 7/1996 | Day et al. | |
| 5,867,995 | A | 2/1999 | Lewis | |
| 6,000,232 | A | 12/1999 | Witten-Hannah et al. | |
| 2005/0223722 | A1 * | 10/2005 | Yamashita ..... | F25B 9/002 62/157 |
| 2008/0289354 | A1 | 11/2008 | Dudley et al. | |
| 2010/0011793 | A1 | 1/2010 | Tiranno et al. | |
| 2010/0089094 | A1 * | 4/2010 | Kondou ..... | F25B 5/02 62/498 |

OTHER PUBLICATIONS

Written Opinion dated Jul. 13, 2012 for International Application No. PCT/BR2011/000455.

* cited by examiner

METHODS FOR CONTROLLING A COMPRESSOR WITH DOUBLE SUCTION FOR REFRIGERATION SYSTEMS

The present application claims priority of Brazilian patent application No. PI1005090-6, its content being hereby incorporated by reference.

The present invention refers to a system and methods for controlling a double suction compressor for application in refrigeration systems, capable of meeting the different demands of cost, efficiency and temperature control by means of techniques of complexity levels and different configurations of the elements from the control loop (temperature sensors, actuators, controllers, etc.). Thus, the present invention offers different methods which are suitable for each specific configuration.

BACKGROUND OF THE INVENTION

At first, some definitions and nomenclatures which will be used throughout the text are provided below for a better understanding of the text.

$F_{DS}$ [Hz]: Switching frequency of the suction lines, that is, the frequency with which the flow of the refrigerant gas is switched between the two suction lines and, consequently, between the two refrigeration circuits.

$P_{DS}$ [s]: Switching period of the suction lines, that is, period of time in a switching cycle of both suction lines is completed. Inverse of $F_{DS}$.

$D_{DS}$ [%]: Suction duty cycle, that is, when there are two suction lines, where the flow of the refrigerant gas through the second line complements that of the first line, there will be a duty between the conduction time of each line and the period $P_{DS}$. It is a duty cycle once it refers to the times existing in a switching period of the suction lines, being possible to vary it in every new period. To identify the duty cycle of each suction line, $D\mathbf{1}_{DS}$ is established as the duty cycle of the first suction line and $D\mathbf{2}_{DS}$ is established as the duty cycle of the second line. The sum of $D\mathbf{1}_{DS}$ and $D\mathbf{2}_{DS}$ must be equal to one, therefore $D_{DS}$ refers to the set of values ($D\mathbf{1}_{DS}$, $D\mathbf{2}_{DS}$), for instance, (80, 20%), (20, 80%), (50, 50%), etc.

$RPM_{DS}$: Rotation of the internal motor of the double suction compressor. It can be a fixed value or zero for conventional fixed capacity compressors (or compressor ON-OFF) or any value within a range of operation, for variable capacity compressors. In a double suction compressor, the value of RPM can be defined for each suction line, as $RPM_{EV1}$ and $RPM_{EV2}$. The refrigeration capacity of a compressor is proportional to the rotation of the internal motor of the compressor or proportional to the other form of pumping the refrigeration gas, for instance, by means of linear actuators.

$CAP_{COMP}$: Refrigeration capacity of a compressor, wherein the capacity value can be a single one or specific for each suction line ($CAP_{COMP}\mathbf{1}$ and $CAP_{COMP}\mathbf{2}$).

$T_{DS}$ [N·m]: Double suction compressor's motor load; that is variable or fixed speed motor. The load will be specific for each one of the two suction lines ($T\mathbf{1}_{DS}$ and $T\mathbf{2}_{DS}$). The load processed by the motor can be obtained directly or indirectly through the acquisition of electrical signals from the motor (voltage, current, phase differences, etc).

Nomenclature adopted in the sequence for elements employed in refrigeration systems:

CDS (Double Suction Control) Device for activating a valve in a double suction compressor—Electronic circuit capable of activating the double suction compressor's internal valve, in a duty cycle $D_{DS}$.

SET (Temperature State Sensor)—Any contact or electrical signal whose state is changed, between two levels, according to certain temperature values, forming a hysteresis window. For instance; electromechanical thermostat and electronic thermostat with relay output to activate a compressor, or an electronic thermostat with digital output to control another actuator which activates the compressor.

SCT (Continuous Temperature Sensor)—Any sensor which delivers a physical quantity (generally voltage or electric current) proportional to a temperature value (NTC, PTC, etc.).

STQ (Load Sensor)—Electronic circuit which provides an electrical signal proportional to the load being processed by the compressor's motor.

ETH (Electronic Thermostat)—Electronic circuit whose main role is to interpret the states or values of the SETs and SCTs and to activate or send a drive control to the compressor.

TSD (Time Starting Device)—Electronic circuit responsible for performing the controlled start-up of a single-phase induction motor employed in fixed capacity compressors.

I-VCC (Inverter of Variable Capacity Compressor)—Electronic circuit called Frequency Inverter, responsible for activating the motor or actuator present in variable capacity compressors.

CVC (Capillary Tube Valve Control) Device for driving the valve that regulates the restriction of the capillary element—Electronic circuit capable of activating a valve positioned in series with the capillary tube of the refrigeration circuit, at a certain frequency and duty cycle.

Double Suction Compressor

The double suction compressor consists of a compressor having two suction lines whose switching occurs internally to the compressor, at a complementary work cycle. Switching occurs by means of a valve, which, on switching once in every period of time $P_{DS}$, distributes the gas flow measurement through one of the suction lines in a period $D\mathbf{1}_{DS} \times P_{DS}$, and through the second suction line in a period $(1-D\mathbf{1}_{DS}) \times P_{DS}$. Valve switching is performed through an electric current applied by an external actuator $C_{DS}$.

The Possible Configurations of the Refrigeration System

The double suction compressor, having a variable or fixed speed actuator or motor, can be employed in different types of refrigeration systems, classified according to their complexity. This classification is made to make it easier to understand the control methods to be proposed, once they are suitable for different goals of cost, efficiency, performance, etc.:

Low Complexity System:

It prioritizes a competitive product through the lowest cost/price of the elements employed. In general, it uses a compressor with fixed rotation motor ("ON-OFF compressor"), electromechanical thermostat with temperature hysteresis control (on, off). In some cases, the thermostat can be electronic to obtain better adjustment of the hysteresis window of controlled temperatures.

Medium Complexity System:

It prioritizes a competitive product through the balance between cost and performance by consumption or temperature control. In general, an additional element, or an element of higher complexity, is used to improve temperature control in one or more compartments, or to reduce energy consumption. For instance, this element can be a compressor with variable displacement or speed actuator or motor (Variable Capacity Compressor, or "VCC compressor", also designated as having capacity performed through the phased variation in its operation state), or flow measurement valves at the capillary elements of each refrigeration circuit. The thermostat can be both electromechanical and electronic.

High Complexity System:

It prioritizes a competitive product through better performance (lower consumption, better temperature control, better design, etc.). In general, a configuration having several elements of higher complexity is used. For instance, this configuration can have a variable capacity compressor, flow measurement valves at the capillary elements, electronic thermostat that reads several sensors distributed in each compartment, etc.

OBJECTIVES OF THE INVENTION

The objectives of this invention consist of providing systems and methods for controlling a double suction compressor for application in refrigeration systems, capable of meeting the different demands for cost, efficiency and temperature control by means of devices and techniques of complexity levels and different configurations of the elements from the control loop (temperature sensors, actuators, controllers, etc.).

BRIEF DESCRIPTION OF THE INVENTION

The objectives of the invention are achieved by means of a system for controlling a double suction compressor for application in refrigeration systems, the refrigeration system comprising at least two evaporators, the double suction compressor being controllable to alternate its compression capacity.

The objectives of the invention are achieved by means of a method for controlling a double suction compressor for application in refrigeration systems, the refrigeration system comprising at least two evaporators, an ON-OFF double suction compressor, one SET temperature sensor, the method being characterized in that it comprises a step for configuring the actuation and control of an ON-OFF double suction compressor with fixed duty cycle, where the control to turn on/off the compressor comes from a single SET element.

The objectives of the invention are also achieved by means of a method for controlling a double suction compressor for application in refrigeration systems, the refrigeration system comprising at least two evaporators, an ON-OFF double suction compressor, two SET temperature sensors, the method being characterized in that it comprises a step for configuring the actuation and control of an ON-OFF double suction compressor with two fixed values for the duty cycle, there being two SET temperature sensors, the compressor being turned off when both thermostats reach their respective temperature reference values (setpoints).

The objectives of the invention are also achieved by means of a method for controlling a double suction compressor for application in refrigeration systems, the refrigeration system comprising at least two evaporators, an ON-OFF double suction compressor, two SET temperature sensors, the method being characterized in that it comprises a step for configuring the actuation and control of an ON-OFF double suction compressor with three or more fixed values for the duty cycle, the duty cycle being chosen among three or more fixed values, according to the logic of control which is based on the reading of both thermostats' states.

The objectives of the invention are also achieved by means of a method for controlling a double suction compressor for application in refrigeration systems, the refrigeration system comprising at least two evaporators, an ON-OFF double suction compressor, two SET or SCT temperature sensors, the method being characterized in that it comprises a step for configuring the actuation and control of an ON-OFF double suction compressor with continuous and variable duty cycle within a work range from 0 to 100%, defined based on the reading of both thermostats, either of SET or SCT type.

The objectives of the invention are also achieved by means of a method for controlling a double suction compressor for application in refrigeration systems, the refrigeration system comprising at least two evaporators, an ON-OFF double suction compressor, one or two SET or SCT temperature sensors, one STQ sensor of $T_{DS}$ load of the motor, the method being characterized in that it comprises a step for configuring the actuation and control of an ON-OFF double suction compressor with continuous and variable duty cycle within a work range from 0 to 100%, defined based on the reading of one single temperature sensor positioned in one of the two evaporators, and on the reading of the load processed by the motor (either a rotary motor or a linear actuator) for each suction line.

The objectives of the invention are also achieved by means of a method for controlling a double suction compressor for application in refrigeration systems, the refrigeration system comprising at least two evaporators, one variable capacity double suction compressor (or VCC compressor), two temperature sensors, the method being characterized in that it comprises a configuration step in which the system control defines the capacity required by each compartment of the system, regulating these capacities through adjustments to the suction duty cycle and through the compressor capacity.

The objectives of the invention are also achieved by means of a method for controlling a double suction compressor for application in refrigeration systems, the refrigeration system comprising at least two evaporators, one variable capacity double suction compressor, one or two SET or SCT temperature sensors, one sensor of $T_{DS}$ load of the motor, the method being characterized in that it comprises a configuration step in which both the duty cycle, variable and continuous, within a work range, and the compressor capacities $CAP_{COMP}\mathbf{1}$ and $CAP_{COMP}\mathbf{2}$, or a combination of both action variables, are defined based on the reading of one or two SET or SCT temperature sensors and on the readings of loads $T\mathbf{1}_{DS}$ and $T\mathbf{2}_{DS}$.

The objectives of the invention are also achieved by means of a method for controlling a double suction compressor for application in refrigeration systems, the refrigeration system comprising a compressor with at least two suctions, two evaporators, one condenser, at least one temperature sensor located in one of the compartments to be refrigerated, having capillary tubes connected to each one of the evaporators, and at least one valve for flow control of one of the suctions, an electronic control operatively linked to the compressor and the valve for suction control, capable of at least detecting the compressor's load point by a process that can be the observation of the input current or the observation of the gap between the current and the voltage applied to the compressor's motor, and of controlling the opening or closing state of the suction valve, whereas the compressor has its on or off operation state determined based on the observation of the temperature in at least one of the compartments, characterized in that the electronic controller keeps the suction valve alternatively opened and closed, at a time relation calculated according to a mathematical function that considers fixed parameters related to predefined characteristics of the refrigeration system, and load parameters measured in the compressor when alternatively connected to the freezer's or refrigerator's suction line.

Particularly, the objectives are achieved through a method for controlling and adjusting the refrigeration capacities of a refrigeration system equipped with a double suction compressor, the refrigeration system comprising compartments to be refrigerated and comprising at least two evaporators 20 positioned at the compartments to be refrigerated 60,70, the double suction compressor 10 being controllable to alternate its compression capacity, the method being characterized in that it comprises steps of: (i) continuously measuring at least a temperature arising from a SET, SCT temperature sensor associated with at least one of the evaporators 20 and (ii) acting on the compression capacity of the compressor 10, based on the measurement of the step (i).

Also, particularly, the objectives are achieved through a system for controlling a double suction compressor 10 for application in refrigeration systems, the refrigeration system comprising at least two evaporators 20, positioned in the compartments to be refrigerated 60,70, the $SC_1$,$SC_2$ double suction compressor 10 being controllable to alternate its compression capacity, the compressor being controlled by an electronic control 90, the system being characterized in that it comprises at least two evaporators 20; the electronic control being configured to act on the compression capacity of the compressor 10, based on the measurement of at least one SET, SCT temperature sensor associated with at least one of the evaporators 20; as well as through a system for controlling a double suction compressor 10 for application in refrigeration systems, the refrigeration system being characterized in that it comprises: one compressor 10 with at least two suctions $SC_1$,$SC_2$, at least two evaporators 20, positioned in the compartments to be refrigerated 60,70, at least one SET,SCT temperature sensor located in one of the compartments to be refrigerated 60,70, having capillary tubes linked to each one of the evaporators, and at least one valve for flow control of one of the suctions $SC_1$,$SC_2$, one electronic control 90 operatively linked to the compressor 10 and to the valve for suction control, the electronic control being configured to detect a load of the compressor 10 and control an opening or closing state of the suction valve, the compressor having its on or off operation state determined based on the observation of a temperature T1,T2 in at least one of the compartments to be refrigerated 60,70, the electronic controller 90 keeping the suction valve alternatively opened and closed, in a time relation calculated from the measurement of at least one SET,SCT temperature sensor associated with at least one of the evaporators 20.

Finally, particularly, the objectives are achieved through a refrigerator that comprises a refrigeration circuit that includes one compressor 10 comprising at least two suctions $SC_1$,$SC_2$, the refrigerator comprising compartments to be refrigerated and comprising at least two evaporators 20 positioned in the compartments to be refrigerated 60,70; an electronic control operatively linked to the compressor and to the valve for suction control; at least one valve for flow control to separate the fluid connection of one of the suctions for one of the evaporators 20; the refrigerator being characterized in that the electronic control 90 is configured to measure at least one variable of behavior of the refrigeration circuit to selectively command the suction valve and alternate an operation state of one of the evaporators 20 at an alternation proportion established by the relation of measurements of at least one variable of behavior of the refrigeration circuit.

BRIEF DESCRIPTION OF THE DRAWINGS

The present invention will be described in more detail below, based on figures:

In FIG. 2*a*, there is a SET element, generally an electromechanical thermostat contact. In FIG. 2*b*, the temperature is measured through a SCT element, and the information is processed by an ETH electronic control for later action implementation. The ETH element can send control signals to another electronic control for activating some actuator in the system, for instance, for a CDS element responsible for activating the valve of the double suction compressor. The control signals (in this example of the figure, as reference for $D_{DS}$) can be discrete (on or off) or continuous. The temperature levels obtained by the SCT element can also be processed by integrated electronic controls, as suggested in 8;

DETAILED DESCRIPTION OF THE FIGURES AND THE INVENTION

The Elements and Variable of the Control Loop

Figure 3:
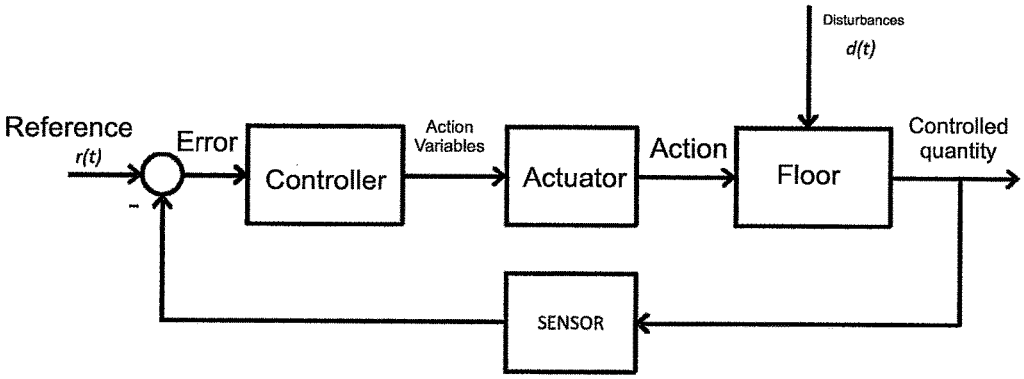
FIG. 3—illustrates a classic diagram of a control loop.

Considering the classic diagram of a control loop (FIG. 3), there is a brief description of the elements existing in a refrigeration system having a double suction compressor.

Basic System

The basic system to be controlled is comprised at least by the passive elements in a refrigeration circuit, such as the heat exchange elements (condenser 30 and evaporator 20) and restriction elements (capillary tube). The compartments to be refrigerated are indirect components of the floor, once they are thermally coupled with the evaporators.

For the cases in which the double suction compressor is used, there are at least two evaporators, where each one is coupled with a different compartment of the refrigeration system (for instance, a freezer compartment and a refrigerator compartment).

Actuators

The actuators are the active elements inside a refrigeration circuit, such as the compressor (in this case, double suction compressor), the compressor's internal valve to switch the suction line, and one or two valves that regulate the restriction of the capillary element of each evaporator. Other actuators can be present, depending on the complexity and scope of the floor, such as dampers, ventilators, block valves, etc.

The double suction compressor can have a conventional motor or a variable rotation one, a linear displacement motor and fixed or variable frequency. In the fixed capacity compressor, or "ON-OFF" compressor, there are two states (on and off), where the refrigerant gas' pumping capacity is fixed when it is on. In the variable capacity compressor, or "VCC", the pumping of the refrigerant gas is regulated according to the rotation of the motor or displacement and frequency of a linear actuator, and there can be a specific capacity for each one of the two suction lines.

In the case of the double suction compressor's internal valve 10', such valve 10' acts by distributing the refrigerant gas to both suction lines, where there will always be one of the lines transporting the gas and never two lines transporting at the same moment ($D1_{DS}+D2_{DS}=1$). The actuator of the compressor's suction line operates at high frequency if compared to the dynamics of the refrigeration system; thus, both evaporators transport the refrigerant gas with pulsation coming from the switch of the suction valve 10' practically imperceptible for the evaporators' heat exchange capacity.

In high complexity systems, there can be valves that regulate the restriction of capillary tubes. These actuators operate at a frequency different from that used to switch the double suction compressor's internal valve, so as to avoid instabilities in the system. In a system having a double suction compressor and at least two evaporators, each evaporator has its capillary element and, therefore, each evaporator can have a restriction regulating valve in series associated with its capillary tube.

Controller

It is the element responsible for controlling the actuators according to the error value between the reference variable and the actual value of the controlled quantity. The controller can be of very low complexity, being only an on and off control, while it can also be gradually more complex, being capable of receiving and interpreting information referring to several quantities of the floor, and controlling several actuators simultaneously through discrete or continuous signals.

In a low complexity system, equipped with a double suction compressor, the controller will receive, at least, information on the temperature of one or more electromechanical thermostats. And based on its control logic, it will control the actuators: suction valve and compressor's motor.

In a high complexity system, equipped with a variable capacity double suction compressor, and also, regulating valves for one or more capillary tubes, the controller may receive a larger set of information, such as the actual temperature at different points of the system, load processed by the compressor's internal motor, compressor consumption, etc. And based on its control logic, it will control the several actuators: compressor's suction valve, speed or displacement of the motor for each suction line, valve(s) that regulate the capillary tube(s), etc.

Sensors

The most elementary sensor in a refrigeration system is the temperature sensor, or thermostat, which can be SET (generally electromechanical) or SCT (sensor coupled with an electronic control or electronic thermostat). The first type, electromechanical SET, is widely used lower cost and low complexity refrigeration systems and provides information on the state of the system; that is, if the measured temperature achieved one of the two values that determine a hysteresis window. In the case of the electronic SCT thermostat, of higher cost and complexity, the temperature is actually and continuously measured (except the measurement errors arising from the tolerance of the temperature sensor, quality of thermal coupling, etc.). The information on the actual temperature is processed by an electronic circuit, where in this process the temperature value is translated into electrical signals for consequent actions of control of the refrigeration system.

As an indirect form of monitoring the work being performed by a refrigeration circuit, it is possible to monitor the load processed by the motor used in the compressor, either of fixed or variable speed or displacement. The STQ load sensor, in turn, is comprised by sensors that monitor electrical quantities of the motor (such as current, voltage, frequency, gap, etc).

Other types of sensors can be present in refrigeration systems equipped with the double suction compressor, for instance, sensors of electric power consumption, door opening sensors, pressure sensors, etc.

References—r(t):

These are the desirable values for the controlled quantities. In a refrigeration system with double suction compressor, in general, the references are related to the temperatures in the evaporators (or in the compartments), in the load values of the motor for each one of the two suctions, etc.

Disturbance—d(t):

It is all interference external to the system floor. In any refrigeration system, the most common disturbances are door opening and addition of thermal load in one or more compartments.

Controlled Quantities:

These are all physical quantities one wishes to control. Such quantities can be monitored directly or indirectly through the sensors; or estimated based on a theoretical model of the system.

Depending on the complexity of the refrigeration system equipped with double suction compressor, such quantities can go from one single temperature up to a set of variables to be prioritized (temperatures, consumption, response speed, etc.).

Action Variables—On-Off $CAP_{COMP}$, $D_{DS}$, etc.:

These are discrete or continuous control variables applied to the actuators. In a refrigeration system with double suction compressor, the main action variables are related to the operation of the compressor (on, off, capacity value) and the operation of the compressor's internal valve (duty cycle and valve's switching frequency).

Adjustment of the Capacity for Two Refrigeration Circuits

In a refrigeration system equipped with a double suction compressor, there are at least two evaporators with refrigeration capacities determined by the duty cycle of the compressor's internal valve. As the valve is switched at a high frequency if compared to the dynamic of the refrigeration system, the evaporators transport the refrigerant gas with pulsation practically imperceptible for the heat exchange capacity ($CAP_{EV}$) of the evaporators.

Thus, a refrigeration capacity is feasible for each evaporator ($CAP_{EV}\mathbf{1}$, $CAP_{EV}\mathbf{2}$) which can be variable according to the duty cycle of the compressor's internal valve, and the compressor's capacity value.

In a system with a fixed capacity compressor (ON-OFF), the variation of the capacity of each evaporator depends on that of the other, once the duty cycles of both suctions are complementary ($D\mathbf{1}_{DS}+D\mathbf{2}_{DS}=1$). In other words, with the compressor turned on:

$$CAP_{EV1} \propto CAP_{COMP} \times D1_{DS}$$

$$CAP_{EV2} \propto CAP_{COMP} \times (1-D1_{DS})$$

$$CAP_{COMP} \propto CAP_{EV1} + CAP_{EV2}$$

Where: $CAP_{COMP}$=Capacity delivered by the compressor;

$CAP_{EV1}$=Evaporator's capacity 1;

$CAP_{EV2}$=Evaporator's capacity 2.

In a system with a variable capacity compressor, the variation of the capacity of each evaporator can be controlled within a wider range, and even uncoupled between the two evaporators through the independent adjustment of each capacity of the compressor for each suction line. For example, a variable capacity compressor equipped with a rotary motor, and the motor being connected in a rotation of same value for the two suction lines, ($RPM_{SET}$), the variation of the capacity of each evaporator will depend on this rotation and on the suction's duty cycle:

$$CAP_{EV1} \propto \frac{RPM_{SET}}{RPM_{MAX}} \times D1_{DS}$$

$$CAP_{EV2} \propto \frac{RPM_{SET}}{RPM_{MAX}} \times (1 - D1_{DS})$$

$$CAP_{COMP} \propto CAP_{EV1} + CAP_{EV2}$$

Where: $RPM_{SET}$=Motor's rotation, kept the same for both suction lines;

$RPM_{MAX}$=Maximum rotation of the compressor's motor VCC.

With the VCC compressor of rotary motor operating at a different rotation for each one of the two suction lines, the variation of the capacity can be made in an independent manner for each evaporator:

$$CAP_{EV1} \propto \frac{RPM_{EV1}}{RPM_{MAX}} \times D1_{DS}$$

$$CAP_{EV2} \propto \frac{RPM_{EV2}}{RPM_{MAX}} \times (1 - D1_{DS})$$

$$CAP_{COMP} \propto CAP_{EV1} + CAP_{EV2}$$

Where: $RPM_{EV1}$ and $RPM_{EV2}$=Motor's rotation, for each one of the suction lines.

Methods of Control Proposed for the Double Suction Compressor

Methods of control are proposed for refrigeration systems equipped with double suction compressor, either a fixed or variable capacity compressor. The methods are mentioned in ascending order of system complexity, seeking to point out the competitive advantages for each solution, either by low cost, low error of temperature, lower consumption, etc.

Figure 4:
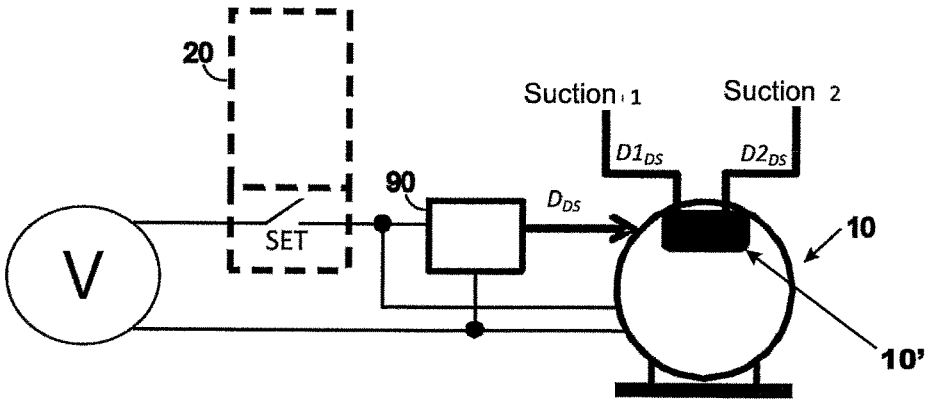
FIG. 4—illustrates an example of control of a double suction compressor, where there is information of only one temperature sensor, in this case, a SET element. The duty cycle $D_{DS}$ has only one fixed value, applied to the compressor whenever it is activated.

1. System with at least two evaporators, with double suction compressor such as ON-OFF, one single SET temperature sensor, and one single value of $D_{DS}$ ratio:

What: Configuration for activating and controlling a double suction compressor ON-OFF with fixed duty cycle ($D_{DS}$), where the compressor's control on/off comes from one single SET element (ex.: contact of electromechanical thermostat). FIG. 4 exemplifies the configuration, where the SET element is a contact which, apart from feeding the compressor, also feeds element CDS 90.

| SET | $D1_{DS}$ | $D2_{DS}$ | Compressor |
|---|---|---|---|
| OFF | OFF | OFF | OFF |
| ON | $D_{FIXED}$ | $1-D_{FIXED}$ | ON |

Why: Have an option for low cost applications, where there is only one electromechanical thermostat and the electronics CDS 90 activate the suctions at a fixed duty cycle, defined, for instance, by means of a simple and lower cost timer.

Note 1: There is 1 SET element (ex.: electromechanical thermostat) and 1 value for duty cycle $D_{DS}$.

Note 2: Here, one of the evaporators will be in "open loop," following the cycle of the other evaporator monitored by the thermostat.

Figure 5:
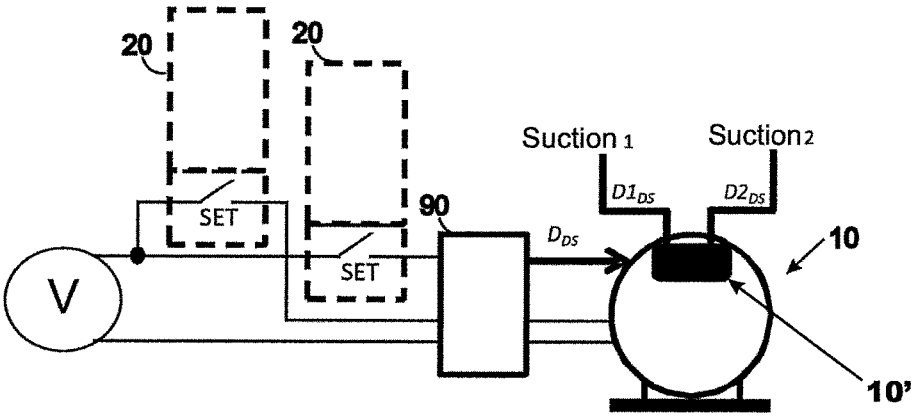
FIG. 5—illustrates an example of control of a double suction compressor, where there is information of two temperature sensors, in this case, two SET elements. The duty cycle $D_{DS}$ has two fixed values, applied to the compressor whenever it is activated, and following some logic related to the information of the temperature sensors.

2. System with at least two evaporators, with double suction compressor such as ON-OFF, two SET temperature sensors and two possible values for DDS ratio:

What: Idem previous configuration, however with two fixed values for the duty cycle $D_{DS}$ (ex.: 80, 20% and 20, 80%), a first value $D1'_{DS}$ being higher than $D2'_{DS}$ and a second value $D1''_{DS}$ being lower than $D2''_{DS}$, with two SET temperature sensors (ex.: two electromechanical thermostats). In this case, the compressor is disconnected when both thermostats achieve their respective temperature reference values (set-points). If the evaporator which is receiving, in this example, 80% of the compressor's capacity, achieves its set-point temperature before the other, the CDS control of the suction valve may modify the duty cycle $D_{DS}$ to its second fixed value, applying the bigger capacity to that evaporator in which the thermostat has not achieved its set-point yet. FIG. 5 exemplifies the configuration, where the SET elements are contacts of electromechanical thermostats, which apart from feeding the compressor, also feed element CDS 90. However, the feeding of element CDS 90 can be independent of the SET elements.

| SET1 | SET2 | D1DS | D2DS | Compressor |
|---|---|---|---|---|
| OFF | OFF | OFF | OFF | OFF |
| OFF | ON | $1\text{-}D2''_{DS}$ | $D2''_{DS} > D1''_{DS}$ | ON |
| ON | OFF | $1\text{-}D2'_{DS}$ | $D2'_{DS} < D1'_{DS}$ | ON |
| ON | ON | $1\text{-}D2_{DS}$ | $D2'_{DS}$ or $D2''_{DS}$ | ON |

Why: Reduce the error of the temperature not controlled in the solution of the previous configuration. The high duty cycle (ex.: freezer 80%, refrigerator 20%) generates capacity in excess in the freezer 60 (first refrigerated environment), and generates deficiency of capacity in the refrigerator 70 (second refrigerated environment). Low duty cycle is the inverse. In this configuration, there will be a dominant SET element (thermostat), or the one which firstly reaches its set-point.

Note 1: There are 2 SET elements (electromechanical thermostats) and 2 possible values for duty cycle $D_{DS}$.

Note 2: Both evaporators will be in closed loop; however one of them will have priority, making the temperature in a second evaporator still capable of traveling outside the limits of the hysteresis of its thermostat. To reduce this error, the following configuration is suggested.

3. System with at least two evaporators, with double suction compressor such as ON-OFF, two SET temperature sensors, and three or more possible values for DOS ratio:

What: Idem previous configuration, however with three or more fixed values for duty cycle $D_{DS}$ (ex.: 50, 50%; 20, 80% and 80, 20%), with two SET elements. The duty cycle $D_{DS}$ is chosen among three or more fixed values, through the combination of both thermostats. Taking FIG. 5 as reference, the condition in which both SET elements are on (ON) has a third value of $D_{DS}$, which can be, for instance, (50, 50%). Therefore, it may be necessary an electronic control CDS 90 with a minimum processing capacity to interpret these combinations and control the suction valve.

Why: Reduce the error of the temperature in a second evaporator, which error exists in the previous configuration.

Note 1: There are 2 SET elements and 3 or more possible values for duty cycle $D_{DS}$.

Note 2: An intermediate value for duty cycle reduces the temperature oscillation of a second evaporator. This configuration becomes no longer interesting (cost) if the solution requires electronics identical to that of the configuration to be suggested in 4 (with the use, for instance, of a microcontroller). In other words, the following configuration brings a control better than that of this configuration and will only show disadvantage if there is higher cost in electronics.

4. System with at least two evaporators, with a double suction compressor such as ON-OFF, two temperature sensors (either SET or SCT), and continuous value for DDS ratio:

What: Configuration for activating and controlling a double suction compressor ON-OFF with variable and continuous duty cycle $D_{DS}$ within a work range (0 to 100%), defined based on the reading of both thermostats, either SET or SCT.

Why: Have continuous adjustment of duty cycle $D_{DS}$ to search for zero error (keep within the hysteresis) in at least two evaporators (freezer 60 and refrigerator 70), improving the performance and efficiency of the refrigeration system.

Note 1: There are 2 temperature sensors (electromechanical or electronic thermostats, such as SET or SCT), and duty cycle $D_{DS}$ with continuous value within a range.

Note 2: An electronic control having capacity of processing signals will have to adjust the duty cycle $D_{DS}$ through an algorithm for controlling the temperatures of the evaporators, taking as re-feeding, the on and off control buttons of both SET (ex.: electromechanical) thermostats, or the temperature values measured by electronic SCT thermostats (FIG. 4 brings examples of use of SET and SCT temperature sensors).

Note 3: One of the advantages of using this configuration is the possibility to control the suction valve with an ideal duty cycle $D_{DS}$ to obtain an operation point, where both thermostats achieve their respective set-point temperatures at the same time, when at permanent regime. For such purpose, control must have an algorithm that searches this operation point based on the re-feeding of both thermostats. By making one of the controlled variables be the moment in which the monitored temperatures (first temperature T1 and second temperature T2) achieve their respective reference values, it is possible to make the compressor's operation time (on) be minimized, that is, the compressor will not need to be on because a single compartment has not achieved the desired temperature. Thus, when the temperature in a first compartment (T1) is above the reference value, the suction duty cycle $D1_{DS}$ is incremented and; in an identical manner, when the temperature in a second compartment (T2) is above the reference value, the suction duty cycle $D2_{DS}$ is incremented.

Figure 6:
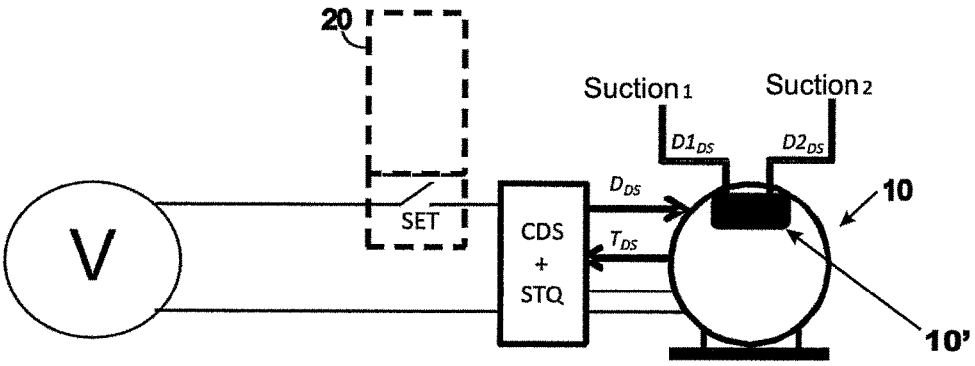
FIG. 6—illustrates an example of control of a double suction compressor, where there is information of one temperature sensor, in this case, one SET element. The CDS element activates the suction valve with duty cycle $D_{DS}$ and has an integrated sensor of STQ load of the compressor's motor (for $T_{DS}$ sensing)

5. System with at least two evaporators, with double suction compressor such as ON-OFF, one or two (SET or SCT) temperature sensors, one STQ sensor of load $T_{DS}$ of the motor, and continuous value for $D_{DS}$ ratio:

What: Configuration for activating and controlling a double suction compressor ON-OFF with variable and continuous duty cycle $D_{DS}$ within a work range, defined based on the reading of a single temperature sensor positioned in one of the evaporators, and on the reading of the load processed by the motor for each suction line ($T1_{DS}$ and $T2_{DS}$). The need of a second temperature sensor is excluded; however a second sensor, positioned in the second evaporator can be used for better controlling the temperature. FIG. 6 exemplifies the configuration where there is a SET sensor (ex.: electromechanical).

Why: Reduce the error of the temperature of the evaporators, in a system with a single temperature sensor, obtaining performance and efficiency with a configuration of a cost lower than that suggested in configuration 4.

Note 1: There is at least one SET or SCT temperature sensor (that is, at least one evaporator has its temperature measured) and the duty cycle $D_{DS}$ with continuous value within a range.

Note 2: If there is preliminary knowledge on the refrigeration system, which relates the motor's load to the thermal load of each evaporator ($T1_{DS}$ and $T2_{DS}$) and the temperature of the monitored compartment (T1), it is possible to estimate the temperature in the compartment not monitored (T2). Thus, the system control will act over the duty cycle $D_{DS}$ until loads $T1_{DS}$ and $T2_{DS}$, together with the reading of the SET or SCT sensor of the monitored compartment, achieve a value that corresponds to the value of the temperature estimated for the compartment not monitored.

6. System with at least two evaporators, with double suction VCC compressor, two (SET or SCT) temperature sensors, continuous value for duty cycle $D_{DS}$, and compressor's independent capacity value for each suction line:

What: Configuration where the system control defines the capacity required by each compartment or evaporator of the system and regulates these capacities $CAP_{EV}$ by means of adjustments to the suction's duty cycle $D_{DS}$ and by means of the compressor's capacity. There may be a capacity of the compressor for each compartment ($CAP_{COMP}1 \neq CAP_{COMP}2$), or a fixed one ($CAP_{COMP}1 = CAP_{COMP}2$), prioritizing the best efficiency or the lowest variation in capacity of the compressor.

Why: By means of the independent adjustment of the capacity in each evaporator, it is possible to reduce consumption, once one of the evaporators will not have its performance impaired by occasional transitions of thermal load in the second evaporator. There is also consumption reduction by obtaining a capacity that is lower than the minimum obtained only by the conventional variable capacity compressor; that is, the capacity of each evaporator is defined by the compressor's minimum capacity and by the duty cycle $D_{DS}$, making it feasible a lower capacity and lower cycling of the compressor.

Note 1: There are two (SET or SCT) temperature sensors, a duty cycle $D_{DS}$ with continuous value within a range, and compressor's capacities, equal or different for each suction line ($CAP_{COMP}1$ and $CAP_{COMP}2$).

7. System with at least two evaporators, with VCC double suction compressor, one or two (SET or SCT) temperature sensors, one sensor of TDS load of the motor, continuous value for duty cycle $D_{DS}$, and independent capacity value of the compressor for each suction line:

What: Configuration identical to the previous one, however with the addition of a sensor for the load processed by motor $T_{DS}$. In this configuration, both the duty cycle $D_{DS}$ (variable and continuous within a work range) and the compressor's capacities $CAP_{COMP}1$ and $CAP_{COMP}2$, or a combination of both variables of action, are defined based on the reading of one or two (SET or SCT) temperature sensors and on the readings of loads $T1_{DS}$ and $T2_{DS}$. By combining this configuration with the proposal in 5, it is possible to perform the control of the system with a single SET sensor (ex.: electromechanical thermostat), and the temperature in the evaporator not monitored (T2) is estimated based on the previous knowledge on the relation between the temperature in the other evaporator (T1) and in loads $T1_{DS}$ and $T2_{DS}$.

Figure 7:
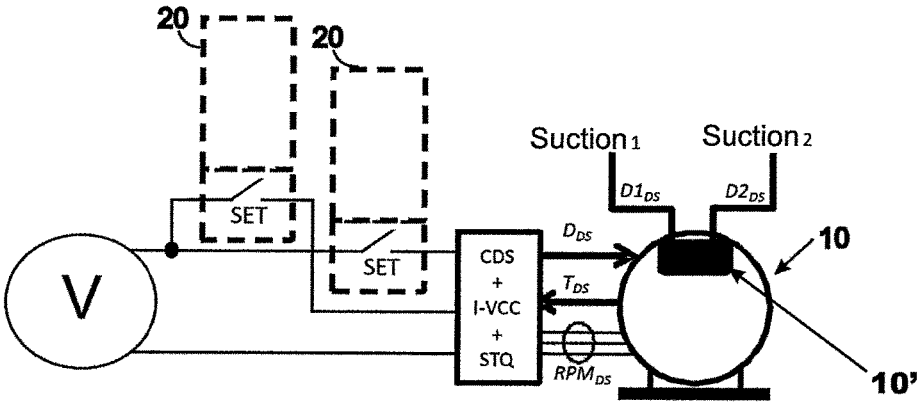
FIG. 7—illustrates an example of control of a variable capacity double suction compressor, where there is information of two temperature sensors, in this case, two SET elements. The CDS element activates the suction valve with duty cycle $D_{DS}$ and is integrated with the I-VCC inverter and sensor of STQ load. The I-VCC inverter can activate the compressor with distinct capacities for $D1_{DS}$ and $D2_{DS}$.

Why: Appropriate adjustment to the capacity of the double suction compressor, without the need of ETH electronic thermostat in the system, but of one or two SET sensors (ex.: electromechanical thermostats) and one sensor for loads $T1_{DS}$ and $T2_{DS}$. Please see FIG. 7.

Note 1: There are one or two (SET or SCT) temperature sensors, one duty cycle $D_{DS}$ with continuous value within a range, and compressor's capacities, which are equal or different for each suction line ($CAP_{COMP}1$ and $CAP_{COMP}2$).

8. System with at least two evaporators, with double suction compressor such as ON-OFF, one or two (SET or SCT) temperature sensors, one control capable of activating and quantifying the load of an induction motor, and continuous value for duty cycle $D_{DS}$:

What: Configuration for activating and controlling a double suction compressor ON-OFF with variable and continuous duty cycle $D_{DS}$ within a work range, defined based on the reading of one or two (SET or SCT) sensors, and on the reading of the load required by the induction motor for each suction line. In this configuration, the system is equipped with a double suction compressor, such as ON-OFF, having one single-phase induction motor, the controller will be able to simultaneously control the power provided to the induction motor, from the alternating current grid of 50 Hz, 60 Hz or another frequency and voltage provided by the commercial power grid, and to control the valve installed in the compressor's suction, by using the information calculated by the controller of the motor regarding the level of load under which this induction motor is operating, and based on a control logic, decide about the proportion of time or number of compression cycles that the compressor will operate by pumping the gas from each one of the suction lines. This controller of the compressor can have at least one controllable bilateral switch (such as Triac) connected in series to the main winding or one for motor operation, whereas the controller measures the phase difference between the voltage and the current applied to this motor, which allows for concluding about the level of load to which this motor is subjected, being possible to conclude, over time, about the evolution of this load applied to the shaft of the motor, enabling to conclude about the proportion and evolution between loads $T1_{DS}$ and $T2_{DS}$ when operating connected to the first or the second suction line, the controller being able to decide about the opening time of the suction valve according to a predefined logic. This load applied to the motor when connected to each one of the suction lines keeps a proportion mainly with the pressures of evaporation and, consequently, the temperatures of evaporation in each evaporator.

Integration of the Controllers to Other Elements of the System

There are suggestions of possible practical embodiments of the control of the double suction compressor integrated to a refrigeration system, where the elements "actuators", "controls," "sensors," inputs for sensor reading and outputs of voltage and current can be integrated into a single electronic control already employed to perform other functions inside the refrigeration system.

The following integrated controls are suggested for the double suction compressor:

A. CDS with fixed timer: Electronic control with the main function of activating the suction valve with a single fixed duty cycle, whenever a single SET element acts (see FIG. 4). The control has a simple timer circuit to define the duty cycle $D_{DS}$ and can be built so as to be coupled or not with the compressor. The control and the compressor can or cannot receive feeding coming from the closing of the SET element. Low cost and complexity control, meeting the needs of the configuration for activation and control according to 1.

B. CDS with fixed timers and sensoring of two SET elements: Electronic control with the main function of activating the suction valve with one of two prefixed duty cycles $D_{DS}$, wherein each one of the two $D_{DS}$ values refers to the actuation of one of two SET elements of the system (see FIG. 5). The control has a circuit with simple timers to define the two $D_{DS}$ values; it has sensors to identify the state of both SET elements and can be built so as to be coupled or not with the compressor. The control and the compressor can or cannot receive feeding coming from the closing of the SET elements. Low cost and complexity control, meeting the needs of configuration for activation and control according to 2.

C. CDS with fixed timers, logical processing capacity, and sensoring of two SET elements: Electronic control with the main function of activating the suction valve with one of three or more prefixed duty cycles $D_{DS}$, wherein the employment of each one of the $D_{DS}$ values is conditioned to a control logic based on the state of at least two SET elements of the system. The control has a circuit with simple timers to define the fixed values of $D_{DS}$; one logical circuit capable of defining the best $D_{DS}$ value based on the state of the SET elements; it has sensors to identify the state of the SET elements and can be built so as to be coupled or not with the compressor. The CDS control and the compressor can or cannot receive feeding coming from the closing of the SET elements. Control of medium cost and complexity, meeting the needs of the configuration for activation and control according to 3.

D. CDS with digital processing capacity, and sensoring of two SET elements: Electronic control with the main function of activating the suction valve with a continuous duty cycle $D_{DS}$ within a range, wherein the $D_{DS}$ value is continuously adjusted according to the control logic based on the state of at least two SET elements of the system. The control has one digital processing element (micro-controller or DSP—Digital Signal Processor); one logic capable of defining the best $D_{DS}$ value based on the state of the SET elements; it has sensors to identify the state of the SET elements and can be built so as to be coupled or not with the compressor. The CDS control and the compressor can or cannot receive feeding coming from the closing of the SET elements. If it is necessary to have the history of the activations of the SET elements to define the best $D_{DS}$ value, the CDS 90 element shall be permanently energized or have the capacity of memorizing its state before the simultaneous disconnection of the SET elements. Higher cost and complexity control, meeting the needs of the configuration for activation and control according to 4.

E. CDS with digital processing capacity, having a STQ element and sensoring of one or two SET elements: Electronic control with the main function of activating the suction valve with a continuous $D_{DS}$ duty cycle within a range, wherein the $D_{DS}$ value is continuously adjusted according to the control logic based on the state of one or two SET elements of the system, and on the values of load processed by the compressor's motor, obtained by the STQ element. FIG. 6 illustrates the configuration where there is only one SET element. The control has one digital processing element (microcontroller or DSP); one logic capable of defining the best $D_{DS}$ value based on the state of one or two SET elements; one STQ element, and it has sensors to identify the state of up to two SET elements, and can be built so as to be coupled or not with the compressor. Higher cost and complexity control, meeting the needs of the configuration for activation and control according to 5.

Figure 1:
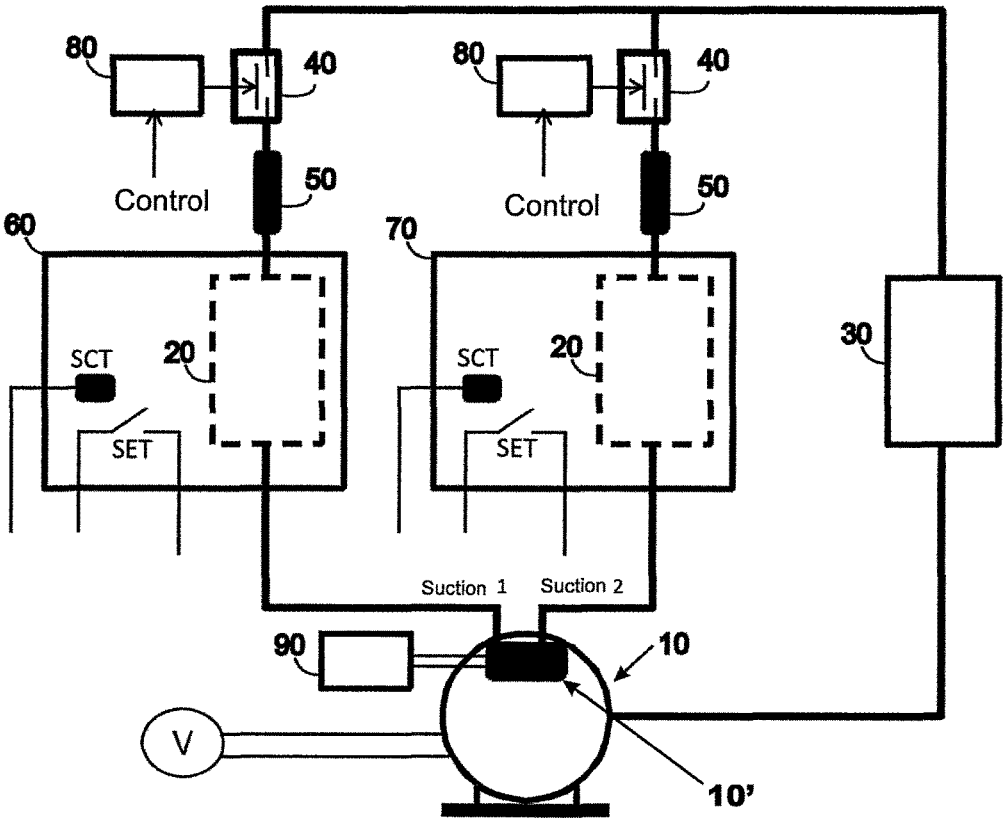
FIG. 1—illustrates an example of application of a double suction compressor to a system with two evaporators. The figure illustrates the CDS element for actuation of the double suction valve internal to the compressor, the compressor with its two suction lines; the two evaporators, each with its temperature sensing means, which can be by SET element (ex.: electromechanical thermostat) or SCT element (ex.: NTC); the optional CVC elements and respective valves that regulate the restriction of the capillary element.
Figure 2:
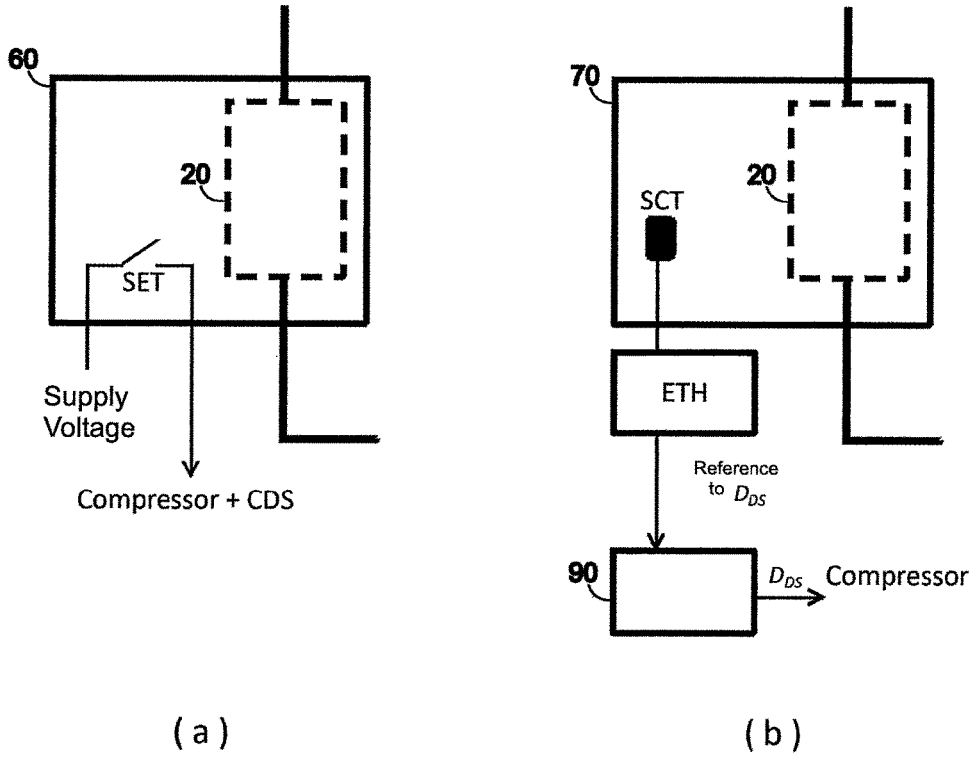
FIG. 2—illustrates two usual forms of temperature sensing in the compartment with which each evaporator is coupled.

F. CDS control follower. Electronic control with the main function of activating the suction valve with a continuous duty cycle $D_{DS}$ within a range, wherein the $D_{DS}$ value is continuously adjusted according to control signals coming from another electronic control, such as an ETH (please see FIG. 2*b*) or I-VCC control. The control has a circuit that follows control signals, translating them into values of duty cycle $D_{DS}$. It can be built so as to be coupled or not with the compressor, or together with the ETH or I-VCC controls. Lower cost and complexity control, being one of the elements necessary to perform the configuration for activation and control according to 6.

G. CDS integrated to I-VCC control: Single electronic set, containing the I-VCC control and the CDS control described in CDS control follower. In this integrated control, the value of $D_{DS}$ and of the capacity of the VCC compressor ($CAP_{COMP}$1 and $CAP_{COMP}$2) are continuously adjusted according to the controls coming from an ETH control. It can be built so as to be coupled or not with the compressor. Higher cost and complexity control, being one of the forms to perform the configuration for activation and control according to 6.

H. CDS integrated with I-VCC and ETH controls: Single electronic set, containing the I-VCC and ETH controls, and the CDS control described in CDS control follower. In this integrated control, the value of $D_{DS}$ and of the capacity of the VCC compressor ($CAP_{COMP}$1 and $CAP_{COMP}$2) are continuously adjusted according to control logic based on the readings of the SCT sensors of the system. The control has a digital processing element (micro-controller or DSP); a logic capable of defining the best set of variables of action ($D_{DS}$, $CAP_{COMP}$1 and $CAP_{COMP}$2) based on the readings of the SCT sensors, and can be built so as to be coupled or not with the compressor. Higher cost and complexity control, being one of the forms to perform the configuration for activation and control according to 6.

I. CDS integrated with I-VCC controls, having a STQ element Single electronic set, containing I-VCC and CDS controls as described in CDS follower of controls, further containing a STQ element (see FIG. 7). In this integrated control the value of $D_{DS}$ and of the capacity of the VCC compressor ($CAP_{COMP}$1 and $CAP_{COMP}$2) are continuously adjusted according to the state of one or two SET elements of the system, and to the values of load processed by the compressor's motor, obtained by the STQ element. The control has a digital processing element (micro-controller or DSP); a logic capable of defining the best set of variables of action ($D_{DS}$, $CAP_{COMP}$1 and $CAP_{COMP}$2) based on the state of one or two SET elements; one STQ element, and it has sensors to identity the state of up to two SET elements, and can be built so as to be coupled or not with the compressor. Higher cost and complexity control, being one of the forms to perform the configuration for activation and control according to 7.

J. CDS integrated with TSD control: Electronic set according to "CDS with fixed timer;" "CDS with fixed timers and censoring of two SET elements"; "CDS with fixed timers, logical processing capacity, and sensoring of two SET elements;" "CDS with digital processing capacity, and sensoring of two SET elements;" "CDS with digital processing capacity, having one STQ element and sensoring of one or two SET elements" and; "CDS follower of controls," integrated with TSD control.

Figure 8:
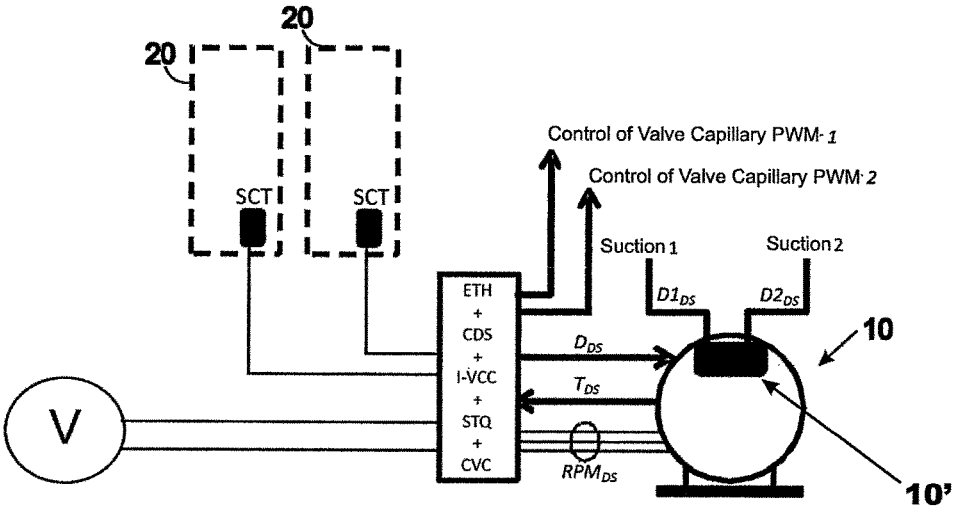
FIG. 8—illustrates an example of control of a variable capacity double suction compressor, where there is information of two temperature sensors, in this case, two SCT elements connected to a single control comprised by one ETH thermostat, one CDS element that activates the suction valve with duty cycle $D_{DS}$, one I-VCC inverter with sensor of STQ load, and CVC controls.
Figure 9:
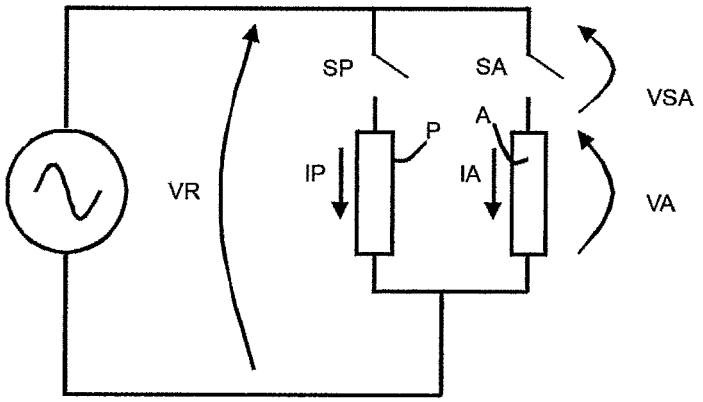
FIG. 9—represents the topology of the single-phase induction motor with the control keys SP and SA for the winding of the main coil P and start-up coil A. It also represents the feeding voltages VR and current in the main winding IP. The current level (IP) observed in the main coil (P) is proportional to the load level (torque T) applied to the motor.
Figure 10:
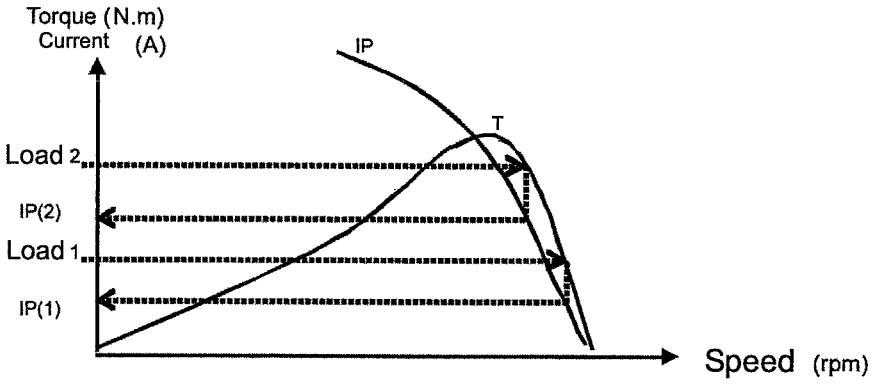
FIG. 10—these different points of load or torque (Load 1 and Load 2) imply current levels (IP2 and IP2).
Figure 11:
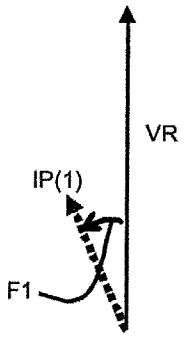
FIGS. 11 and 12—represent the current levels observed in the motor's working winding when operating with different loads (Load 1 and Load 2), and it is also represented the gap (F1, F2) between the current vector (IP) and the voltage vector (VR) of the grid, respectively. This angle is changed with the motor's load level (Load).
Figure 12:
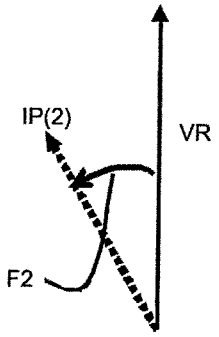
Figure 13:
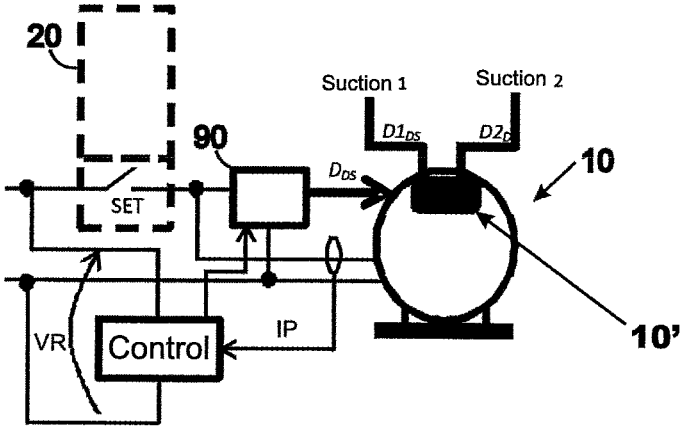
FIG. 13—represents the full control system connected to the compressor, and the control module (Control) receives the grid's voltage information (VR), the current information in the main winding of the motor (IP), and this current level changes between the values (IP1 and IP2) depending if the compressor is connected to suction 1 or suction 2. This control (Control) calculates, according to this information of load and predefined parameters, the moments in which the suction valve must be activated (CDS) through the control signal (control for the suction valve).

K. CDS integrated with CVC control: Electronic set according to "CDS with digital processing capacity, and sensoring of two SET elements;" and "CDS with digital processing capacity, having one STQ element and sensoring of one or two SET elements" integrated with CVC 80 control, where one single digital processing element (micro-controller or DSP) defines the variables of action $D_{DS}$ and the duty cycle of the valve(s) that regulate 40 the restriction 50 of the capillary element (please see FIG. 8).

L. CDS integrated with CVC control follower of controls: Electronic set according to "CDS follower of controls," integrated with CVC 80 control, with two circuits that follow control signals, translating them into values of duty cycle $D_{DS}$ and duty cycle of the valve(s) that regulate 40 the restriction 50 of the capillary element. It can be built so as to be coupled or not with the compressor.

A possible alternative solution for the control logic of the system is represented in FIGS. 9, 10, 11, 12 and 13.

In this solution, a refrigerator, comprised by a compressor with at least two suctions, the refrigerator having at least two evaporators, one condenser, at least one temperature sensor located in one of the compartments to be refrigerated, having capillary tubes connected to each one of the evaporators, and at least one valve for controlling the flow of one of the suctions, an electronic control operatively connected to the compressor and the valve for suction control, capable of at least detecting the compressor's load point by a process that can be the observation of the input current or the observation of the gap between the current and the voltage applied to the compressor's motor, and of controlling the suction valve's opening or closing state, wherein the compressor has its on or off operation state determined based on the observation of the temperature in at least one of the compartments, characterized in that the electronic controller keeps the suction valve alternatively opened and closed, at a time relation calculated according to a mathematical function that considers fixed parameters related to predefined characteristics of the refrigeration system, and load parameters measured in the compressor when alternatively connected to the freezer's or refrigerator's suction line.

This mathematical function considers predefined parameters of the project on the refrigeration system, such as the temperatures desired in each cabinet, its corresponding pressure of saturation of the refrigerant gas, and the relation between these pressures, and parameters measured from the compressor which are the loads of the compressor when connected to each one of the suction lines, and the proportion between these loads.

After describing examples of preferred embodiments, it shall be understood that the scope of the present invention encompasses other possible variations, being limited only by the contents of the attached claims, where the possible equivalents are included.

The invention claimed is:

1. A system for controlling a double suction compressor (10) for application in refrigeration systems, the system comprising an electronic control (90) and at least two evaporators (20), positioned respectively in first and second compartments to be refrigerated (60,70), the double suction compressor (10) being controllable to alternate said compressor's compression capacity, the compressor (10) being controlled by the electronic control (90), wherein:

the compressor (10) comprises a valve (10'), the valve (10') being located inside the compressor, the electronic control acts on the compression capacity of the compressor (10), from the measurement of at least a temperature sensor (SET,SCT) associated with at least one of the evaporators (20), wherein:

the action on the compressor's capacity ($CAP_{COMP}$) is performed through the connection and intermittent disconnection of the operation of the compressor (10), the electronic control (90) controls an interchange of operation of each one of the suctions ($SC_1$, $SC_2$) of the compressor's (10) double suction, and the interchange of operation of the compressor's suctions is performed, by means of the valve (10') located inside the compressor (10), through switching of said valve's (10') operation in a least a duty cycle ($D1_{DS}$, $D2_{DS}$), the switching of the valve's (10') operation being performed in an alternating complementary manner between each one of the suctions ($SC_1$,$SC_2$) wherein $D1_{DS}+D2_{DS}=1$ such that the suctions ($SC_1$,$SC_2$) always operate alternatively when the compressor is operated, in a way that there will always be one of the suctions ($SC_1$, $SC_2$) transporting a refrigerant gas and never two suctions ($SC_1$, $SC_2$) transporting at the same time, each suction ($SC_1$,$SC_2$) operating only during the respectively corresponding duty cycle ($D1_{DS}$, $D2_{DS}$) associated therewith, the electronic control (90) modulating the interchange of operation of the compressor's suctions ($SC_1$, $SC_2$) such that the frequency of the interchange is higher than the dynamics of the refrigeration system, therefore providing simultaneous cooling of the first and second compartments, wherein the at least two evaporators (20) transport the refrigerant gas with pulsation coming from the switching of the valve's (10) operation in a way that said switching is substantially imperceptible for the evaporator's heat exchange capacity.

2. The system according to claim 1, wherein the electronic control (90) controls the modulation between each one of the suctions ($SC_1$,$SC_2$) in variable duty cycles ($D1_{DS}$, $D2_{DS}$).

3. The system according to claim 1, wherein the modulation comprises a duty cycle ($D1_{DS}$, $D2_{DS}$) with a fixed duty cycle value between each one of the suctions ($SC_1$,$SC_2$).

4. The system according to claim 3, further comprising a single temperature sensor (SET,SCT) to measure a first temperature (T1), the temperature sensor (SET,SCT) being positioned in a compartment to be refrigerated (60,70) and which, in turn, is related to a first suction line ($SC_1$) which operates in the first duty cycle ($D1_{DS}$).

5. The system according to claim 4, wherein the electronic control (90) is configured to turn on the compressor (10) when the first temperature (T1) is above a reference value.

6. The system according to claim 5, further comprising temperature sensors (SET,SCT) positioned in different compartments to be refrigerated (60,70), the electronic control (90) being configured to turn off the compressor (10) when both the first temperature (T1) and a second temperature (T2) achieve temperature reference values.

7. The system according to claim 5, further comprising temperature sensors (SET,SCT) positioned in different compartments to be refrigerated (60,70), the electronic control (90) being configured to increase the compressor's (10) capacity if the first temperature (T1) or a second temperature (T2) achieves temperature reference values at different moments.

8. The system according to claim 7, wherein the electronic control (90) is configured to control the interchange of operation of the compressor's (10) suctions ($SC_1$,$SC_2$) through modulation with a duty cycle ($D1_{DS}$, $D2_{DS}$), the modulation being performed in a complementary manner between each one of the suctions ($SC_1$,$SC_2$), and being chosen among the three fixed values of duty cycle from the combination of values obtained from the first temperature (T1) and from the second temperature (T2).

9. The system according to claim 1, wherein the compressor (10) is configured to have its capacity adjustable through the phased variation in its operation state.

10. The system according to claim 9, wherein the compressor (10) is a variable capacity one.

11. The system according to claim 10, wherein the electronic control is configured to control the interchange of operation of the compressor's (10) suctions ($SC_1$,$SC_2$), performed through modulation with a duty cycle ($D1_{DS}$, $D2_{DS}$), the modulation being performed in a complementary manner between each one of the suctions ($SC_1$,$SC_2$).

12. The system according to claim 11, wherein the modulation comprises variable duty cycles ($D1_{DS}$, $D2_{DS}$) between each one of the suctions ($SC_1$,$SC_2$).

13. The system according to claim 12, wherein a refrigeration capacity of a first refrigerated compartment (60), related to the capacity of a first evaporator ($CAP_{EV}1$) related to a first suction line ($SC_1$), and that the refrigeration capacity of a second refrigerated compartment (70), related to the capacity of a second evaporator ($CAP_{EV}2$) related to a second suction line ($SC_2$), result from a multiplication of the compressor's (10) capacity ($CAP_{COMP}$) and from the respective suction duty cycles ($D1_{DS}$,$D2_{DS}$).

14. The system according to claim 13, wherein the electronic control is configured so that a first suction line ($SC_1$) is activated from the measure of the first temperature (T1) and that the second suction line ($SC_2$) is activated from the second temperature (T2).

15. The system according to claim 14, wherein the value of the duty cycles ($D1_{DS}$, $D2_{DS}$) and the capacity values of the compressor ($CAP_{COMP}1$,$CAP_{COMP}2$) are defined based on the reading of two temperature sensors (SET,SCT), the first temperature sensor (SET,SCT) being related to the first temperature (T1) of the first refrigerated compartment (60), which in turn is related to the first suction line ($SC_1$) which operates in a first duty cycle ($D1_{DS}$) and that the second temperature sensor (SET,SCT) is related to the second temperature (T2) of a second refrigerated compartment (70), which in turn is related to a second suction line ($SC_2$) which operates in a second duty cycle ($D2_{DS}$).

16. The system according to claim 15, wherein a demand for capacity of the first refrigerated compartment (60), related to the capacity of a first evaporator ($CAP_{EV}1$), is obtained through the reading of the first temperature (T1) and that a demand for capacity of the second refrigerated compartment (70), related to the capacity of the second evaporator ($CAP_{EV}2$), is obtained through the reading of the second temperature (T2).

17. The system according to claim 16, wherein the value of the duty cycles ($D1_{DS}$, $D2_{DS}$) and the values of the compressor's capacity ($CAP_{COMP}1$,$CAP_{COMP}2$) are defined based on the reading of two or more temperature sensors (SET,SCT) and based on the reading of a load sensor (STQ) of the compressor (10), where at least a first sensor is related to the first temperature (T1) of the first refrigerated compartment (60), which in turn is related to a first suction line ($SC_1$) which operates in a first duty cycle ($D1_{DS}$) and in that the second temperature sensor (SET,SCT) is related to the second temperature (T2) of a second refrigerated compartment (70), which in turn is related to a second suction line that operates in a second duty cycle ($D2_{DS}$).

18. The system according to claim 17, wherein the values of the duty cycles ($D1_{DS}$, $D2_{DS}$) are defined based on the reading of a first temperature (T1) and based on the reading of a load sensor (STQ) of the compressor (10), a second estimated temperature ($T2_E$) being calculated from the value of the reading of a load sensor (STQ).

19. A refrigeration system comprising:

a compressor having a suction capacity ($CAP_{COMP}$) and the compressor comprises a valve, the valve being placed inside the compressor;

at least first and second evaporators associated with respective first and second compartments to be refrigerated and operably connected to said compressor through respective first and second suction lines;

a temperature sensor associated with at least one of the evaporators;

the compressor controlled by an electronic control based upon input from said temperature sensor, wherein said electronic control operates a valve inside the compressor to alternate suction between the first and second suction lines such that refrigerant flows in only one of said suction lines at any given time through switching of the compressor's valve (10') in a first duty cycle ($D1_{DS}$) associated with the first suction line and a second duty cycle ($D2_{DS}$) associated with the second suction line, the switching of the valve (10') being performed in an alternate complementary manner between the first and second suction lines such that the sum of the first duty cycle ($D1_{DS}$) and the second duty cycle ($D2_{DS}$) always equals 100% of said compressor suction capacity ($CAP_{COMP}$) and such that the compressor always alternates suction between the first and second suction lines according to the respective first and second duty cycles ($D1_{DS}$,$D2_{DS}$) when the compressor is operated, in a way that there will always be one of the suctions (SC1, SC2) transporting a refrigerant gas and never two suctions (SC1, SC2) transporting at the same time, so that the compressor provides for simultaneous refrigeration of the first and second compartments by way of alternating suction in the first and second suction lines;

the electronic control modulating the interchange of operation of the compressor's suctions to the first and second evaporators such that the frequency of interchange is higher than the dynamics of the refrigeration system, therefore providing simultaneous cooling of the first and second compartments, wherein the two evaporators (20) transport the refrigerant gas with pulsation coming from the switching of the valve's (10) operation in a way that said switching is substantially imperceptible for the evaporator's heat exchange capacity.

20. The refrigeration system according to claim 19, wherein the first and second duty cycles are variable duty cycles.

21. The refrigeration system according to claim 19, wherein the first and second duty cycles are fixed duty cycles.

22. The refrigeration system according to claim 19, wherein the temperature sensor comprises a first temperature sensor that measures a first temperature (T1) of a first refrigerated compartment that is associated with said first evaporator.

23. The refrigeration system according to claim 22, wherein the electronic control turns on the compressor when the first temperature (T1) is above a reference value.

24. The refrigeration system according to claim 23, further comprising a second temperature sensor that measures a second temperature (T2) of a second refrigerated compartment that is associated with said second evaporator, wherein the electronic control turns off the compressor when both the first temperature (T1) and the second temperature (T2) achieve respective first and second temperature reference values.

25. The refrigeration system according to claim 23, further comprising a second temperature sensor that measures a second temperature (T2) of a second refrigerated compartment that is associated with said second evaporator, wherein:

the electronic control increases the first duty cycle if the second temperature (T2) achieves a second reference value before the first temperature (T1) achieves a first reference value; and the electronic control increases the second duty cycle if the first temperature (T1) achieves the first reference value before the second temperature (T2) achieves the second reference value.

26. The refrigeration system according to claim 25, wherein the first duty cycle and the second duty cycle are each selected by the electronic control from a group of duty cycles comprising three fixed duty cycle values based upon the first temperature (T1) and the second temperature (T2).

27. The refrigeration system according to claim 19, wherein the compressor is a variable capacity compressor.

* * * * *